United States Patent [19]

Williams

[11] Patent Number: 4,993,647

[45] Date of Patent: Feb. 19, 1991

[54] TWO STAGE SEPARATOR APPARATUS

[76] Inventor: Robert M. Williams, 16 La Hacienda, Ladue, Mo. 63124

[21] Appl. No.: 498,619

[22] Filed: Mar. 26, 1990

[51] Int. Cl.[5] ..... B02C 23/32

[52] U.S. Cl. ..... 241/52; 241/79.1; 241/80; 241/81

[58] Field of Search ..... 241/52, 53, 79.1, 80, 241/81, 97

[56] References Cited

U.S. PATENT DOCUMENTS 4,550,879 11/1985 Tanaka et al. ..... 241/80 X
4,626,343 12/1986 Folsberg ..... 241/79.1 X
4,682,738 7/1987 Chang ..... 241/79.1 X
4,689,141 8/1987 Folsberg ..... 241/79.1 X

*Primary Examiner*—Timothy V. Eley
*Attorney, Agent, or Firm*—Gravely, Lieder & Woodruff

[57] ABSTRACT

A material separator apparatus for obtaining refined material subjected to a first grind reduction which is moved into the separator where the large and/or heavier particles of the material are separated out and returned by gravity to fall back into the first grind reduction for further reduction while the finer ground material is subjected to a second separation by a rotary separating device having an array of spaced members which allow the passage of particles smaller than the spacing between members and the larger particles are refused passage and fall back for further reduction.

10 Claims, 1 Drawing Sheet

TWO STAGE SEPARATOR APPARATUS

BACKGROUND OF THE INVENTION

1. Field of the Invention

This invention relates to apparatus for separating the output of material grinders into fine material while returning coarse material that requires further reduction.

2. Description of the Prior Art

In the reduction of coarse material, like rock, coal and similar substances, the grinding apparatus has a tendency to discharge the product before it has been reduced to a uniform desired size. Heretofore the grinding apparatus has been provided with product separation means for the purpose of allowing the desired fines to pass on to the outlet while returning the coarse fractions for further reduction. In some instances the coarse returning fractions accumulate in a large enough mass to obstruct the fine discharge from the grinding apparatus. This latter situation is undesirable as the output is obstructed and the power to drive the apparatus is increased in order to be able to move the mass of material which has considerable density.

When the mass of material increases there is a lack of effective separation from two standpoints. One is that when the air flow is too high the larger particles are carried along with the fines and get into the conduit and drift along as an impedement to uniform flow. When the outlet conduit connects into a burner, the large particles reach the combustion zone and fail to burn completely. In the second case, the power to drive the rotating blade elements increases rapidly when the mass of material becomes dense, and greater horse power is required.

BRIEF DESCRIPTION OF THE INVENTION

A principal object of the invention is to provide material separation in a two stage separation apparatus in which a first stage of the apparatus employs blades rotating in a horizontal path that throws or centrifuges the material particles from the grinding zone into outward peripheral positions of rotation where gravity can pull the larger particles back toward the grinder, and a second stage that receives particles in a horizontal flow so that the desired fine particles are passed out of the apparatus in a vertical flow while large particles are rejected for further reduction.

Another object of the invention is to perform material separation in two stages where the movement of material leaving the grinding phase enters the separating phase without obstructing the material flow path by accumulation of a mass of material that resists the air propelling medium.

Yet another object is to provide apparatus to effect the efficient separation of ground material at minimum power consumption, and under a controllable blower induced air flow.

BRIEF DESCRIPTION OF THE DRAWINGS

Apparatus suitable for carrying out the objects of the invention is depicted in the drawings, wherein.

DETAILED DESCRIPTION OF THE APPARATUS

Figure 1:
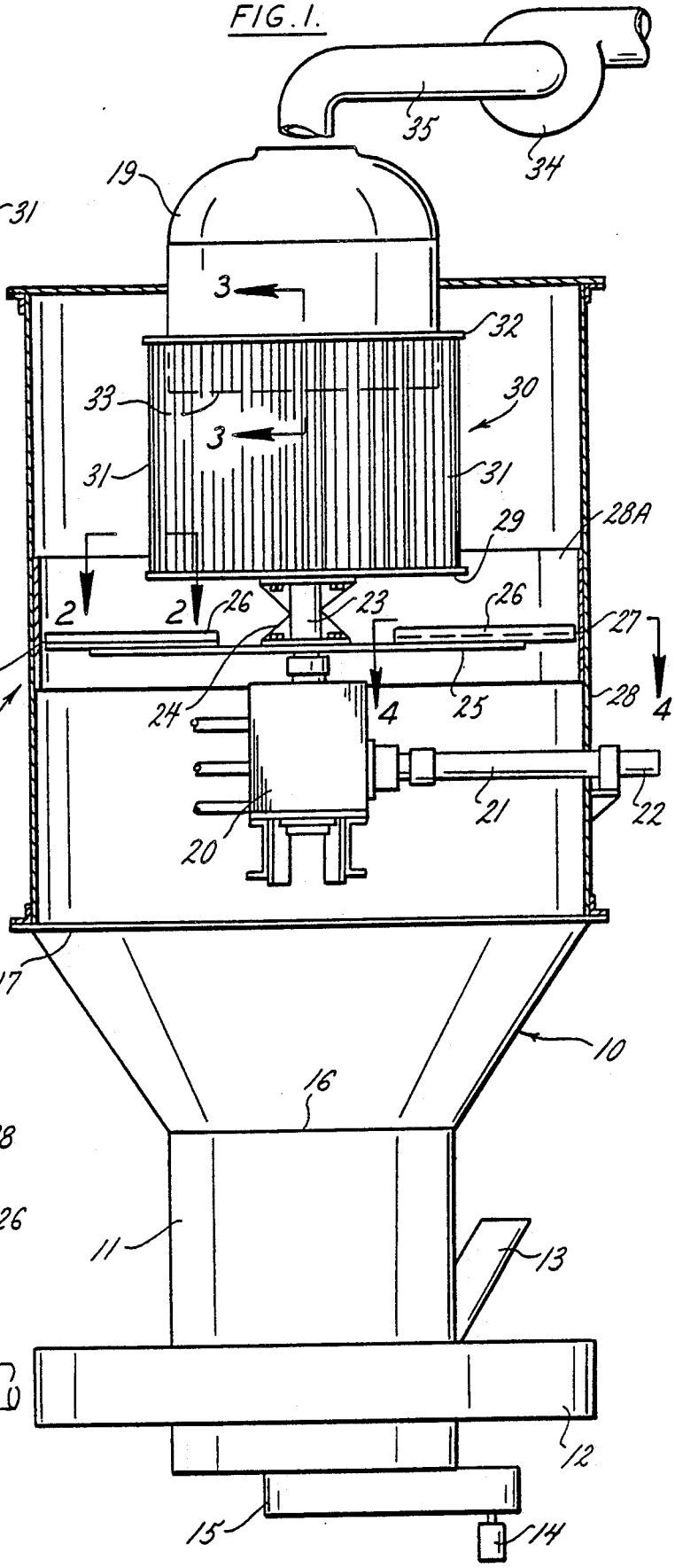
FIG. 1 is a vertical sectional view of grinding apparatus have a two storage separation device associated therewith.

The apparatus is seen in a vertical section in FIG. 1 to be composed of a base housing 10 for enclosing the material grinding mechanism (not shown but similar to the roller grinding mechanism seen in FIG. 1 of U.S. Pat. No. 4,522,343). The grinding mechanism housing 11 is associated with a bustle 12 which allows air to enter the grinding mechanism, much like that in FIG. 2 of the foregoing patent. Material to be ground is introduced at a feeder gate 13, and the power input is by a driven shaft 14 at the gear box 15.

The outlet end 16 of the grinding mechanism base housing 10 is connected in any suitable manner to the inlet end 17 of a casing structure 18 which provides a chamber in which the separation of the material takes place after it has gone through a grinding and reduction process in the grinding mechanism, which by itself plays no part in the present invention. The structure has an outlet hood 19 which collects the ground material of the proper size for transport to a place of use, or storage if not directly used.

The chamber structure 18 encloses a gear box 20 connected to a power input shaft 21 connected to an external shaft 22 for a prime mover (not shown). The gear box 20 has an output shaft 23 provided with a hub 24 which carries a rotor disc 25 carrying a plurality of blades 26 (two being shown) which extend radially out from the hub 24 so the tip ends 27 sweep close to the inner surface of a liner 28A carried by the chamber wall 28.

Figure 3:
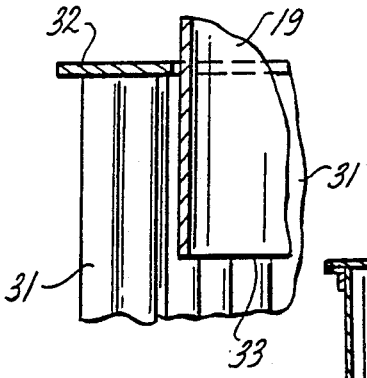
FIG. 3 is a further fragmentary sectional view taken along line 3—3 in FIG. 1.

The shaft 23 extends upwardly to connect to a disc 29 spaced above the disc 25. The disc 29 forms a close bottom to a rotor cage 30 which rotates on a vertical axis that is perpendicular to the plane of rotation of the rotor disc 25. The disc 29 supports a plurality of bar elements 31 (see FIG. 2) that are set in an evenly spaced circular array to constitute the bars for the rotor cage 30. The bar elements 31 are retained at the upper ends in a stabilizer ring 32, and the ring 32 encircles the inner end extension 33 of the hood structure 19 which forms the outlet for the chamber. The configuration of the ring 32 (see in FIG. 3) is such that it rotates with a close fit around the inner end 33 to substantially prevent flow of material in by-pass of flowing between the spaces between the bar elements.

Figure 2:
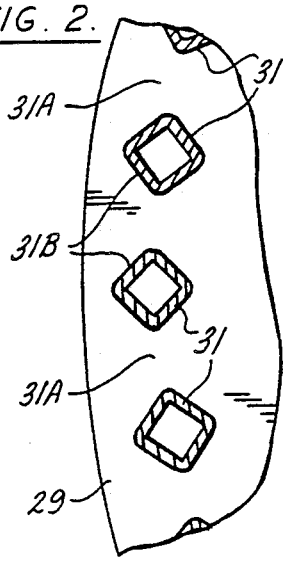
FIG. 2 is a fragmentary sectional view of the cage performing one stage of the separation of ground material, it being taken along line 2—2 of FIG. 1.
Figure 4:
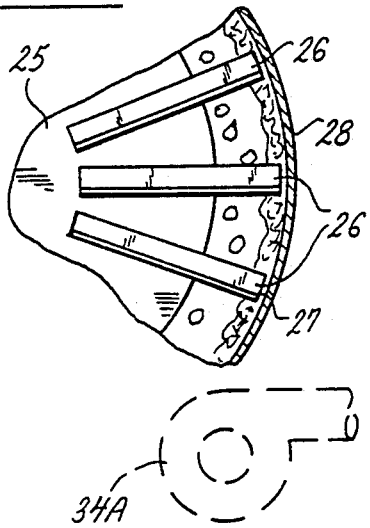
FIG. 4 a fragmentary plan view taken along line 4—4 in FIG. 1.

The details of the rotor cage structure is better understood from FIG. 2. Each bar element 31 is a tube 31 which can be substantially square (in section) and fixed in position on the bottom disc 29 and on the upper ring 32 by the use of suitable welding technique as is well understood in the art. The bottom disc 29 forces the material to flow upwardly around the outside of the rotor cage structure, where it can be moved through the spaces 31A by the air flow through the hood 19. The rotating cage structure 30 includes an upper ring 32 connecting the upper ends of the bar elements 31, and the ring 32 has a close fit around the stationary hood extension 33 to prevent the material particles by passing the cage. Any large particles which strike the flat surfaces 31B of the bars 31 are forceably thrown out in the space surrounding the rotor cage 30 and slide by gravity down along the inside surface of the casing 28 for further reduction. Concurrently, the mass of initially ground material is lifted by the air flow of suction from a top located blower 34 connected by conduit 35 from the hood 19. Of course if a blower 34A is connected directly to the bustle 12 (see the dotted line of blower 34A in FIG. 1), the air flow will lift the material, the same as if it is being sucked by a top blower 34. The large particles that flow past the inner ends of the blades 26 do not have to move through the mass of material above the blades at the outside of the cage 30. The material at the outer ends of the blades is thrown to the side wall 28 where it can collect and slide down by gravity effect along the side wall 28 for further reduction. The effect on this is that a rather dense mass of material collects adjacent the wall 28 so that the particles that are spaced from the secondary stage separation rotor cage do not have a dense mass to pass through.

It is believed apparent from the foregoing description that the material to be ground in the grinder mechanis, and moved into the material refining apparatus is subjected to a first separation where the larger and/or heavier particles are collected in a position where it can return by gravity for further reduction, and to a second separation where a rejection of some material is effected by an array of rotating bar elements arranged in a substantially even spacing of a dimension that determines the fineness of the material to be discharged from the apparatus.

Modifications may come to mind from the foregoing disclosure without departing from the spirit of the invention set forth.

What is claimed is:

1. In apparatus for processing the output material from a power operated grinder so as to obtain a desired substantially uniform fineness size particle output, the improvement of a ground material separating device associated with the output of the power operated grinder comprising:

(a) a chamber having an inlet connected to the grinder to receive the output of ground material therefrom, and having an outlet;

(b) a power operated drive shaft in said chamber;

(c) a bladed rotor connected to said drive shaft and rotatable in an orbit within said chamber to effect one stage separation of the ground material wherein oversize particles are centrifuged in said chamber to the outside and gravity returned to said grinder for further reduction;

(d) a rotor cage connected to said drive shaft and positioned adjacent said chamber outlet to effect another stage separation of the ground material, said rotor cage having means for allowing a predetermined size of ground material particles to pass to said chamber outlet; and (e) power operated air moving means connected to the apparatus for establishing a flow of air through said chamber inlet to propel the ground material particles responsive to the air velocity through said chamber outlet.

2. The improvement set forth in claim 1 wherein said air moving means establishes the air flow past said bladed rotor and subsequently into said rotor cage whereby said bladed rotor performs a first stage separation and said rotor cage performs a second stage separation.

3. The improvement set forth in claim 1 wherein said bladed rotor moves in a plane perpendicular to said drive shaft and said rotor cage rotates on an axis perpendicular to said bladed rotor.

4. The improvement set forth in claim 1 wherein said rotor cage comprises a series of bar elements arranged in a circular array and retained by a disc at one end of said bar elements and by a circular ring at opposite ends of said bar elements.

5. The improvement set forth in claim 4 wherein said bar elements are arranged in a circular array with substantially equal spaced between said bar elements.

6. The improvement set forth in claim 4 wherein said bar elements present particle deflecting surfaces to the air flow to deflect oversized material particles for either direction of rotation of said drive shaft.

7. In apparatus for processing the output material from a power operated grinder so as to obtain a desired substantially uniform fineness size particle output, the improvement of a ground material separating device associated with the output of the power operated grinder comprising:

(a) a chamber having an inlet connected to the grinder to receive the output of ground material therefrom, and having an outlet;

(b) a power operated drive shaft in said chamber;

(c) a bladed rotor connected to said drive shaft and rotatable in an orbit within said chamber to effect an initial separation thereof by moving larger particles in one stage of separation of the ground material wherein the initial particle separation in said chamber is collected adjacent at the periphery of said chamber and returned to said grinder by gravity for further reduction;

(d) a rotor cage connected to said drive shaft and positioned adjacent said chamber outlet to effect a further stage separation of the ground material, said rotor cage having a series of spaced rod means arranged in a circular array for allowing a predetermined size of ground material particles to pass through the spaces in the circular array to said chamber outlet; and (e) power operated air moving means connected to the apparatus for establishing a flow of air through said chamber inlet to propel the ground material particles responsive to the air velocity through said bladed rotor and said rotor cage for eventual passage through said chamber outlet.

8. The improvement set forth in claim 7 wherein said bladed rotor moves in a plane perpendicular to said drive shaft and said rotor cage rotates on an axis perpendicular to said bladed rotor.

9. The improvement set forth in claim 7 wherein said rotor cage comprises a series of bar elements arranged in a circular array and retained by a disc at one end of said bar elements and by a circular ring at the opposite ends of said bar elements.

10. The improvement set forth in claim 9 wherein said bar elements present flat surfaces to the inwardly directed air flow and said flat surfaces deflect oversized material particles opposite to the air flow for at least one direction of rotation of said drive shaft.

* * * * *